US010682658B1

(12) United States Patent
Youdovin

(10) Patent No.: US 10,682,658 B1
(45) **Date of Patent: *Jun. 16, 2020**

(54) CONCENTRATED CLEANING CAPSULE AND ATOMIZER FOR DISPENSING CLEANING SOLUTION THEREFROM

(71) Applicant: Butler's Brand, Inc., New York, NY (US)

(72) Inventor: David N. Youdovin, New York, NY (US)

(73) Assignee: Butler's Brand, Inc., New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/423,526

(22) Filed: May 28, 2019

(51) Int. Cl.
*B05B 7/04* (2006.01)
*B05B 11/00* (2006.01)
*B08B 3/02* (2006.01)

(52) U.S. Cl.
CPC ..... *B05B 7/0408* (2013.01); *B05B 11/0054* (2013.01); *B05B 11/0081* (2013.01); *B08B 3/026* (2013.01)

(58) Field of Classification Search
CPC ... B05B 11/0081–0083; B05B 11/3052–3057; B05B 11/0038; B05B 11/0054; B05B 15/30–37; B65D 51/2814–2892
USPC ..... 222/80–88, 321.7–321.9, 383.1–383.3, 222/325–327
See application file for complete search history.

(56) References Cited

U.S. PATENT DOCUMENTS 2,655,286 A 10/1953 Barbaro
3,655,096 A 4/1972 Easter
3,966,089 A 6/1976 Klingaman
4,355,739 A * 10/1982 Vierkotter ..... B05B 11/3083 222/134
4,618,076 A * 10/1986 Silvenis ..... B05B 11/0037 222/331

(Continued)

FOREIGN PATENT DOCUMENTS

KR 2014-0004697 U 8/2014

OTHER PUBLICATIONS

International Searching Authority, International Search Report and Written Opinion for International Application No. PCT/US2019/048766, dated Feb. 27, 2020, (9 pages), Korean Intellectual Property Office, Republic of Korea.

*Primary Examiner* — Paul R Durand
*Assistant Examiner* — Randall A Gruby
(74) *Attorney, Agent, or Firm* — Alston & Bird LLP

(57) ABSTRACT

In an example embodiment, an atomizer for dispensing cleaning solution from a capsule is provided. The atomizer comprises a handle, a base, and an atomizer pipette extending from the nozzle to the base. The handle comprises a nozzle, a trigger, a lever, the atomizer pipette, and a capsule chamber. The base comprises a reservoir portion configured for receiving cleaning solution from the capsule. The handle is configured to be secured to the base. When the capsule is positioned within the capsule chamber and the lever is moved from an open position to a closed position, the cleaning solution is provided to the reservoir portion. When the capsule is positioned within the capsule chamber, the handle is secured to the base, and the trigger is activated, the cleaning solution is dispensed from the reservoir portion through the atomizer pipette and out of the nozzle.

19 Claims, 4 Drawing Sheets

(56) References Cited

U.S. PATENT DOCUMENTS

Figure 1:
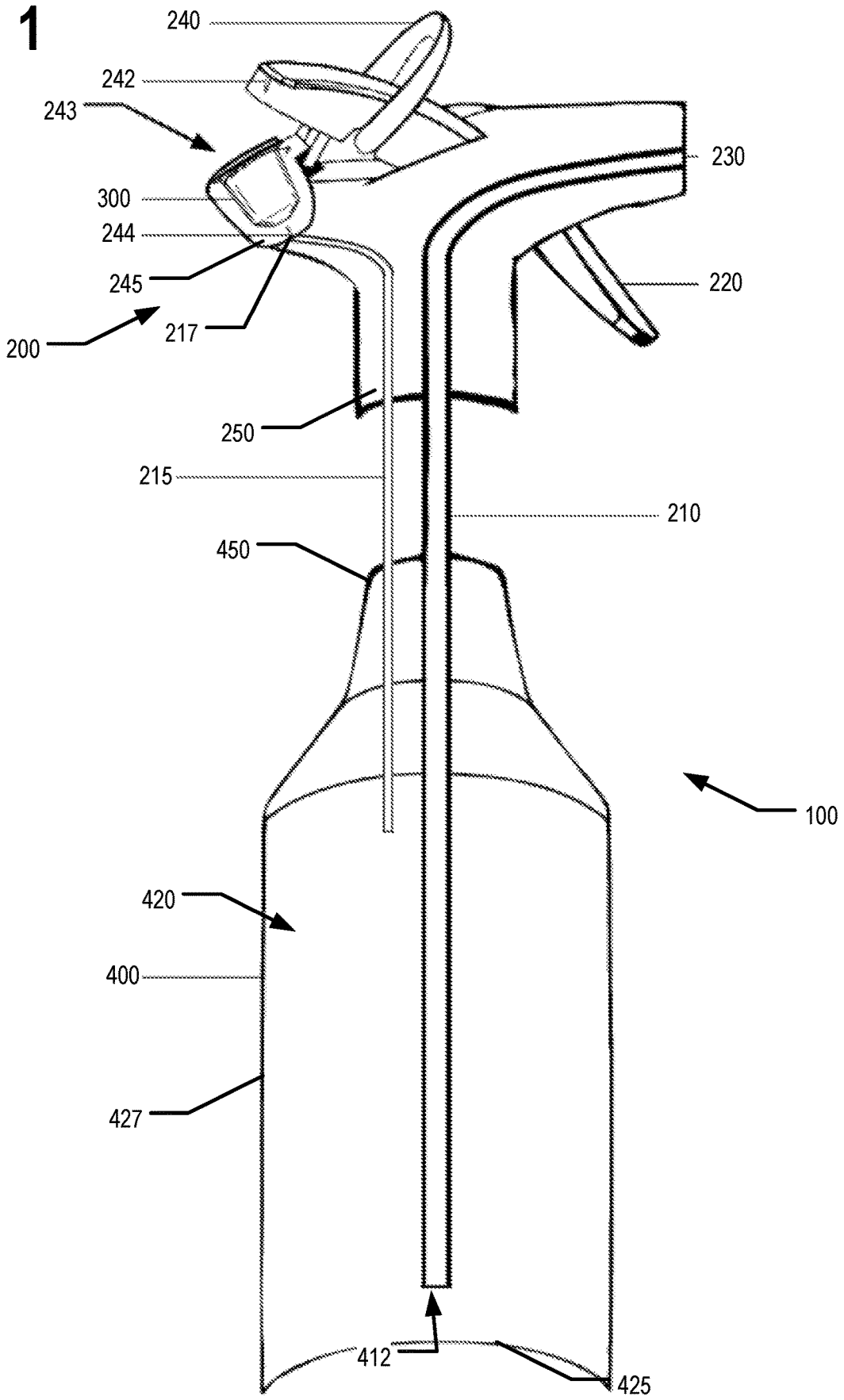

D314,916 S * 2/1991 Brooks ..... D9/448
5,056,685 A * 10/1991 Wild ..... B05B 11/00412 222/82
5,397,029 A * 3/1995 West ..... B65D 83/202 222/79
5,657,910 A * 8/1997 Keyser ..... B05B 11/3045 222/382
5,836,479 A 11/1998 Klima et al.
5,887,761 A * 3/1999 Foster ..... B05B 11/007 222/383.1
5,964,377 A * 10/1999 Demarest ..... B05B 11/3004 222/136
6,041,969 A * 3/2000 Parise ..... B05B 11/0078 206/219
6,152,326 A * 11/2000 Klima, Jr. ..... B05B 11/3081 222/82
D435,792 S * 1/2001 Peloquin ..... D9/448
6,997,351 B2 2/2006 Cho
7,163,130 B2 * 1/2007 Lafond ..... B05C 17/00503 222/326
8,157,131 B2 * 4/2012 Sim ..... B05B 11/0054 215/386
8,235,310 B2 * 8/2012 Birrenkott ..... B05B 7/2443 239/327
8,261,943 B2 * 9/2012 Sim ..... B05B 11/0054 222/129
8,281,960 B1 10/2012 Gers
8,528,784 B2 * 9/2013 Sim ..... B05B 11/0054 222/129
9,028,457 B2 * 5/2015 Leach ..... A61M 1/02 604/290
9,533,331 B1 * 1/2017 Kane ..... B01F 13/0027
9,987,645 B2 * 6/2018 Richman ..... B05B 11/0054
2002/0020720 A1 * 2/2002 Schmid ..... B05B 11/0056 222/383.1
2005/0224515 A1 10/2005 Mon et al.
2006/0086759 A1 4/2006 Herzog
2006/0196885 A1 * 9/2006 Leach ..... A61M 1/02 222/82
2008/0001002 A1 * 1/2008 Garon ..... B05B 7/2408 239/67
2008/0314928 A1 * 12/2008 Banco ..... B05B 11/3011 222/145.5
2009/0095822 A1 * 4/2009 Chen ..... B05B 11/0056 239/302
2009/0212077 A1 8/2009 Carden
2009/0277928 A1 * 11/2009 Bruckner ..... B05B 11/0078 222/129
2010/0024834 A1 * 2/2010 Oglesby ..... A24F 47/006 131/194
2010/0096414 A1 * 4/2010 Dennis ..... B05B 11/0005 222/383.1
2010/0206903 A1 8/2010 Banco et al.
2011/0174837 A1 * 7/2011 Nelson ..... B01F 15/0205 222/129
2011/0236002 A1 * 9/2011 Oglesby ..... A61M 11/047 392/386
2013/0193232 A1 * 8/2013 Dobias ..... A01M 7/0046 239/308
2015/0352571 A1 * 12/2015 Petkus ..... B05B 7/2464 222/1

* cited by examiner

CONCENTRATED CLEANING CAPSULE AND ATOMIZER FOR DISPENSING CLEANING SOLUTION THEREFROM

BACKGROUND

In general, a user may wish to have various cleaning solutions for cleaning different surfaces. For example, a user may wish to have a glass cleaning solution, a bath cleaning solution, a general purpose kitchen cleaning solution, a metal cleaning solution, and/or the like. However, traditional cleaning arrangements require users to maintain store separate reservoirs of cleaning solution corresponding to each desired use cleaning solution. The user may not want or be able to dedicate enough storage space to a plurality of reservoirs of cleaning solution to accommodate a plurality of different reservoirs of cleaning solutions.

BRIEF SUMMARY

Example embodiments of the present invention provide concentrated cleaning capsules configured to store concentrated cleaning solution and an atomizer for dispensing the concentrated cleaning solution therefrom. Example embodiments of the present invention allows a user to have multiple types of cleaning solution, without requiring the user to have multiple atomizers. Example embodiments of the present invention provide a user with a single use amount of cleaning solution.

According to one aspect of the present invention, an atomizer for dispensing a cleaning solution from a capsule is provided. In an example embodiment, the atomizer comprises a handle, a base, and two pipettes extending from the handle into the base. The handle comprises a nozzle, a trigger, a lever, a reservoir pipette, an atomizer pipette, and a capsule chamber. The base comprises a reservoir portion configured for receiving cleaning solution from the capsule. The handle is configured to be secured to the base. When the capsule is positioned within the capsule chamber and the handle is secured to the base and the lever is closed, the cleaning solution is provided to the reservoir portion through the reservoir pipette. When the capsule is positioned within the capsule chamber, the handle is secured to the base, the lever is closed, and the trigger is activated, the cleaning solution is dispensed from the reservoir portion through the atomizer pipette and out of the nozzle.

In an example embodiment, the atomizer pipette extends from the handle into the base. When the handle is secured to the base and the atomizer pipette is inserted into the body of the base, cleaning solution can be transferred and/or dispensed (e.g., in a stream, mist, and/or the like) by pull of the trigger on the handle from the atomizer pipette to the atomizer mechanism.

In an example embodiment, the base comprises a reservoir portion configured to receive a dilution chemical configured to dilute the cleaning solution. The dilution chemical is dispensed from the reservoir portion of the base through the atomizer pipette and out of the nozzle with the cleaning solution. In an example embodiment, the dilution chemical comprises water (e.g., distilled water, ionized water, filtered water, and/or tap water).

In an example embodiment, the lever comprises and/or is coupled to a first puncture pin configured to puncture a first surface (e.g., the lid portion) of the capsule. In an example embodiment, the capsule is configured to be inserted into the capsule chamber and securing the capsule into the capsule chamber by closing and/or actuating the lever causes the first puncture pin to puncture a first surface (e.g., the lid portion) of the capsule disposed within the capsule chamber. In an example embodiment, the capsule chamber comprises a second puncture pin configured to puncture a second surface (e.g., the cup portion) of the capsule. In an example embodiment, the capsule chamber is configured to hold the capsule and cause the second puncture pin to puncture the cup portion of the capsule when the lever is closed and/or actuated. Closing and/or actuating of the lever causes at least one of (a) the first puncture pin to create a first puncture hole in a first surface (e.g., the lid) of the capsule or (b) the second puncture pin to create a second puncture hole in a second surface (e.g., the cup portion) of the capsule. In an example embodiment, closing the lever causes the cleaning solution to be infused into the reservoir pipette and secures the capsule within the handle. For example, the second puncture pin may be a hollow puncture pin that is coupled to the reservoir pipette such that cleaning solution may flow through the second puncture pin and into the reservoir pipette. The cleaning solution may then flow through the reservoir pipette into the reservoir portion.

In an example embodiment, the capsule is configured to contain 0.5 to 2 ounces of the cleaning solution. In an example embodiment, the capsule is configured to contain 0.25 to 1.25 ounces of cleaning solution (e.g., 0.5 to 1 ounce). In an example embodiment, the capsule is configured to contain 1.5 to 3 ounces of the cleaning solution. In an example embodiment, the capsule is configured to contain 1-2 ounces of the cleaning solution. In an example embodiment, the reservoir portion has a convex end surface configured to direct the cleaning solution toward a mouth of the atomizer pipette. In an example embodiment, the mouth of the atomizer pipette extends from the center of the handle into the center of the base. In an example embodiment, the base comprises a metal. In an example embodiment, the reservoir portion has a capacity of 10-30 ounces. In an example embodiment, the reservoir portion has a capacity of 5 to 15 ounces. In an example embodiment, the reservoir portion has a capacity of 20 to 40 ounces.

According to another aspect of the present invention, a capsule is provided. In an example embodiment, a capsule comprises a cup portion; a ridge portion; and a lid portion. The lid portion is configured to seal cleaning solution within the cup portion. The ridge portion is configured for securing the capsule within a capsule chamber.

In example embodiments, the capsule is configured to contain 1-2 ounces of the cleaning solution. In an example embodiment, the capsule is configured to contain 0.5 to 2 ounces of the cleaning solution. In an example embodiment, the capsule is configured to contain 1.5 to 3 ounces of the cleaning solution. In an example embodiment, at least a portion of the capsule comprises metal. In various embodiments, the capsule may be comprised of a natural post recycled material, rubber, aluminum, plastic, cardboard, paper, etc. The shape of the capsule may be round/spherical, cubic, ovoid, polyhedron (e.g., a tetrahedron, pyramid, cuboid, rectangular cuboid, etc.), and/or the like, as appropriate for the application.

According to yet another aspect of the present invention, a method of dispensing a cleaning solution from a capsule is provided. In an example embodiment, the method comprises providing an atomizer. The atomizer comprises a handle comprising a capsule chamber configured to receive a capsule containing cleaning solution therein, a base, and an atomizer pipette extending from the nozzle into a reservoir portion of the base. The handle comprises the nozzle, a trigger, a lever, a reservoir pipette, an atomizer pipette, and the capsule chamber. The base comprises a reservoir portion configured for receiving cleaning solution from the capsule, for example, via the reservoir pipette. The method further comprises inserting the capsule into the capsule chamber; securing the handle to the base; and closing and/or actuating the lever to cause the cleaning capsule to be punctured to enable the cleaning solution to flow into the reservoir portion through the reservoir pipette. The method further comprises diluting the cleaning solution with a dilution chemical in the reservoir portion and activating the trigger. Activating the trigger causes cleaning solution and dilution chemical to be dispensed from the reservoir portion, through the atomizer pipette, and out of the nozzle.

BRIEF DESCRIPTION OF THE SEVERAL VIEWS OF THE DRAWING(S)

Figure 2:
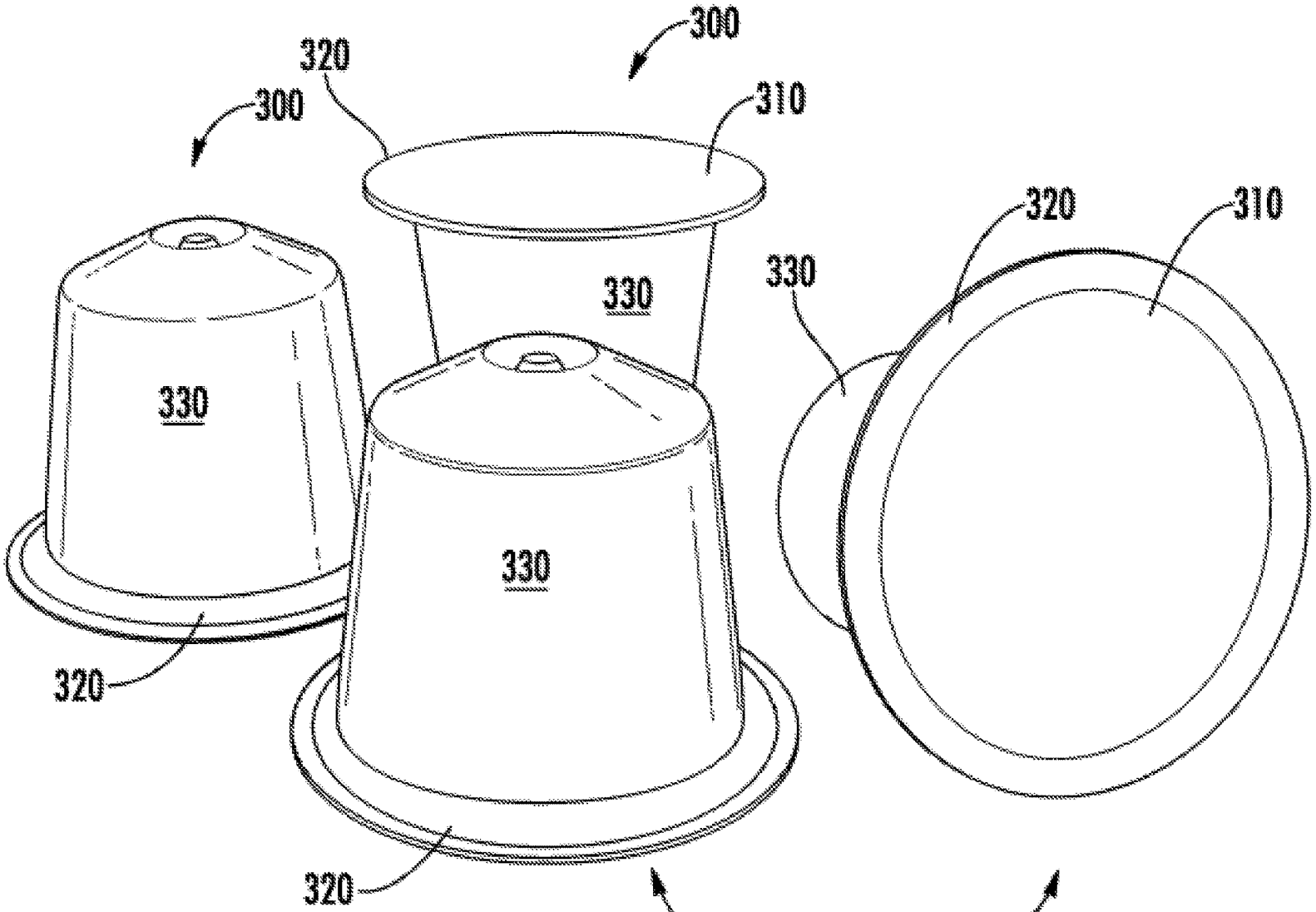
Figure 3:
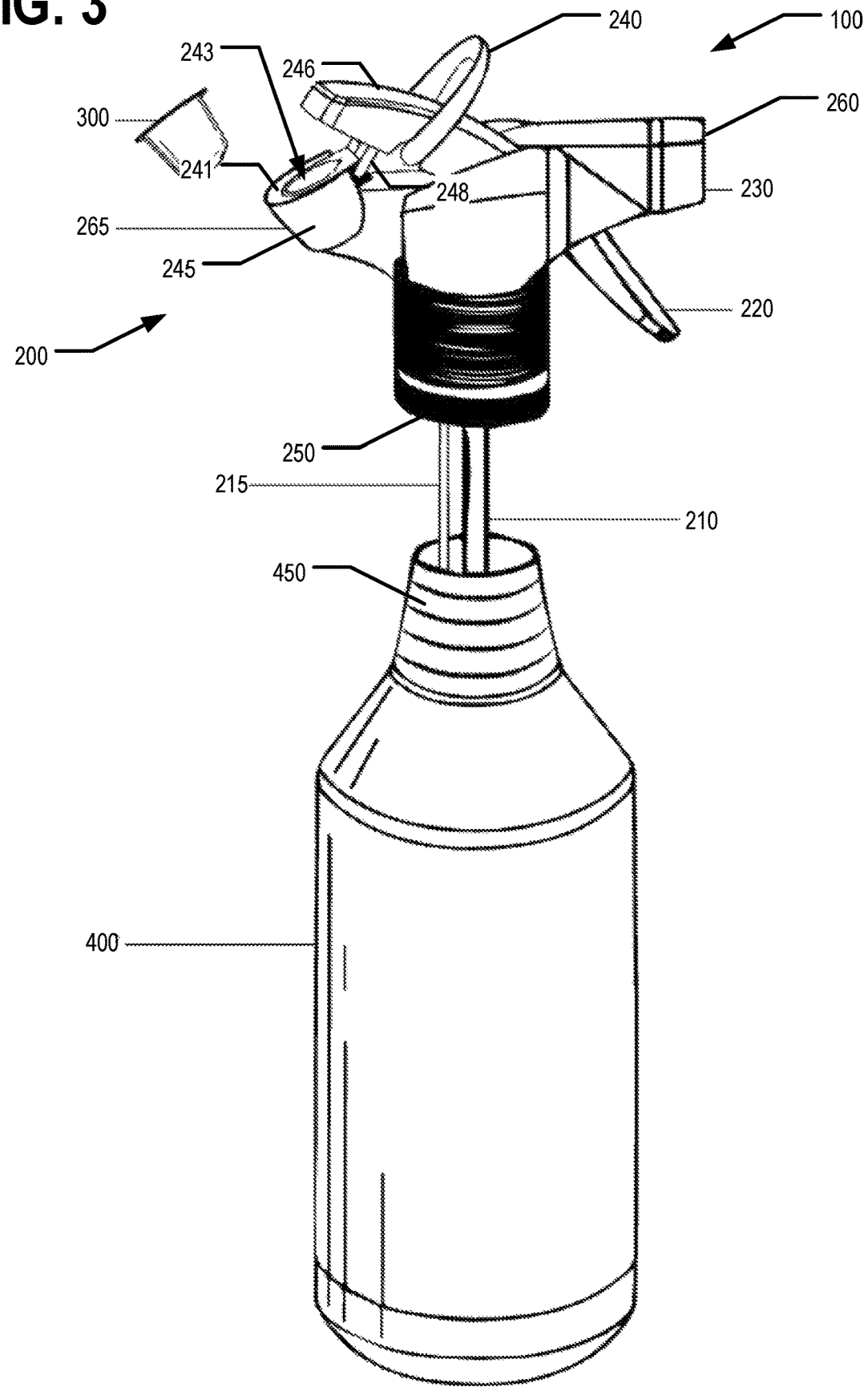
Figure 4:
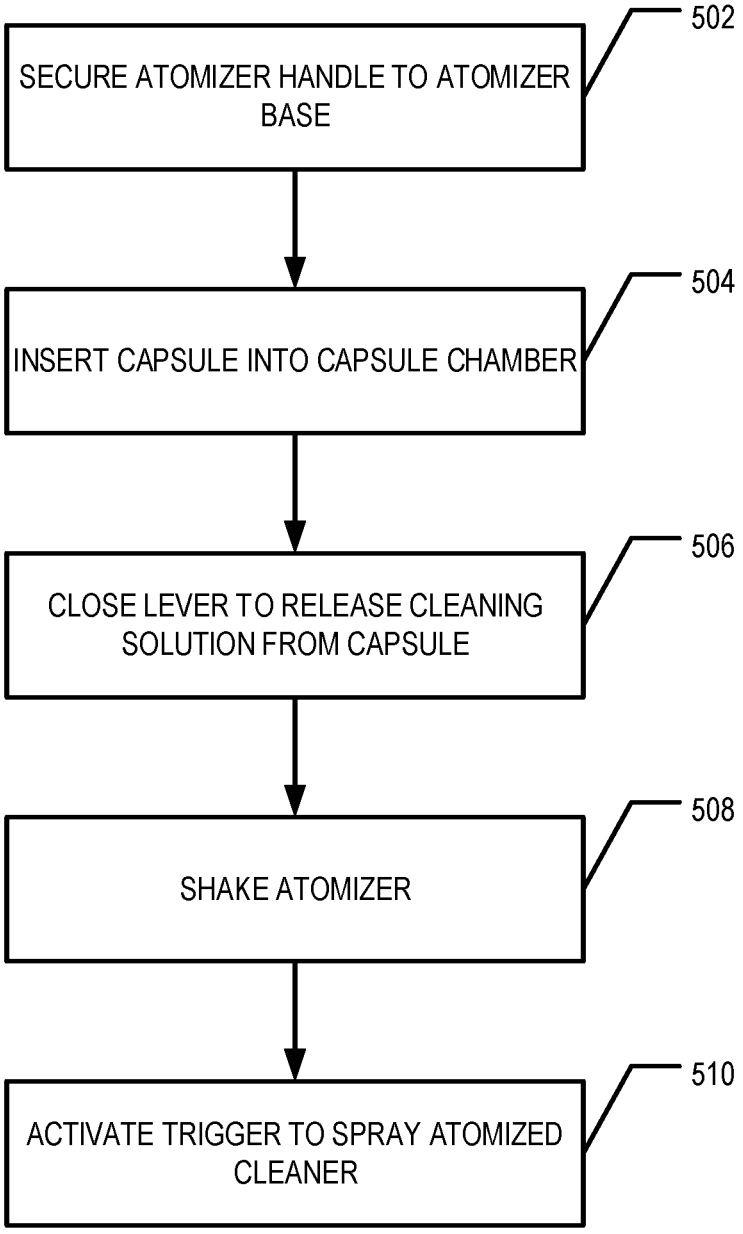

Having thus described the invention in general terms, reference will now be made to the accompanying drawings, which are not necessarily drawn to scale, and wherein:

FIG. 1 is a partially exploded cross-section view of an atomizer with a cleaning capsule therein, in accordance with an example embodiment;

FIG. 2 provides perspective views of four cleaning capsules, in accordance with example embodiments;

FIG. 3 is a perspective view of an atomizer, in accordance with an example embodiment; and FIG. 4 provides a flowchart illustrating various processes for using an atomizer and cleaning capsule, in accordance with example embodiments.

DETAILED DESCRIPTION EXAMPLE EMBODIMENTS

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

Example embodiments of the present invention provide cleaning capsules for storing and providing concentrated cleaning solution and an atomizer for diluting the concentrated cleaning solution and dispensing the diluted cleaning solution. FIGS. 1, 2, and 3 show an example atomizer 100 and example cleaning capsules 300. In general, a user may place a cleaning capsule 300 within an atomizer 100 to provide cleaning solution to the atomizer. The user may then use the cleaning solution. In an example embodiment, a cleaning capsule 300 may be configured to contain approximately one cleaning session worth of cleaning solution such that when the user is finished cleaning, the user need not store unused cleaning solution. The atomizer 100 may generally comprise a handle 200 and a base 400. In example embodiments, the handle 200 may be configured to receive a cleaning capsule 300 therein (e.g., within a capsule chamber) and provide a trigger 220 and a nozzle 230 such that when the trigger is activated, the cleaning solution is dispensed through the nozzle 230. Various aspects of cleaning capsules 300 and the atomizer 100 will now be described in more detail below.

Exemplary Cleaning Capsule

In an example embodiment, a cleaning capsule 300 is configured to hold cleaning solution therein. In an example embodiment, the cleaning capsule 300 comprises a first surface and a second surface. For example, in an example embodiment, the first surface is at least a part of a lid portion 310 of the cleaning capsule 300 and the second surface is at least a portion of a cup portion 330 of the cleaning capsule 300. The cup portion 330 is configured to hold cleaning solution therein. The lid portion 310 is configured to seal the cleaning solution within the cup portion 330. The cleaning capsule 300 may further comprise a ridge portion 320. The ridge portion 320 may be where the lid portion 310 is secured to the cup portion 330. The ridge portion 320 may further be configured to assist in securing the cleaning capsule 300 into the capsule chamber 245 of the atomizer. For example, the ridge portion 320 may be configured to aid in the alignment of the cleaning capsule within the capsule chamber 245 of the atomizer 100 or be secured within the capsule chamber 245 or other portion of the atomizer 100.

In example embodiments, the cup portion 330 is configured to hold one to two ounces of cleaning solution. In an example embodiment, the capsule is configured to contain 0.5 to 2 ounces of the cleaning solution. In an example embodiment, the capsule is configured to contain 1.5 to 3 ounces of the cleaning solution. In other embodiments, smaller or larger volumes of cleaning solution may be accommodated by the cup portion 310. In an example embodiment, the cup portion 330 is configured to hold a single cleaning session worth of cleaning solution. For example, the cup portion 330 may be configured to hold enough cleaning solution to clean the windows of one house or apartment, to clean one bathroom, and/or the like. In various embodiments, the cup portion 330 may be configured to hold between about 10-100 doses (each dose corresponding to a single actuation of the atomizer to dispense a dose of cleaning solution through the nozzle). In example embodiments, the cleaning solution may be a concentrated cleaning solution. In some embodiments, the concentrated cleaning solution may be of a cleaning solution strength that is ready to use. In some embodiments, the cleaning solution may be intended to be diluted (e.g., by putting water or another dilution chemical into the reservoir portion 420 before the cleaning solution to the reservoir portion). For example, the cleaning solution may be a bathroom cleaning solution, window cleaning solution, metal cleaning solution, general purpose or universal cleaning solution, and/or the like. In example embodiments, the cup portion 330 may be color-coded based on the cleaning solution type contained therein. In example embodiments, the cup portion 330 may be made of aluminum, another metal, plastic, cardboard, paperboard, a natural post-consumer recycled material, or another appropriate material and/or combination thereof.

In example embodiments, the lid portion 310 may be configured to seal the cleaning solution within the cup portion 330. For example, the cup portion 330 may comprise an opening and the lid portion 310 may seal the opening. In example embodiments, the lid portion 310 comprises aluminum (e.g., a rigid sheet of aluminum and/or aluminum foil), another metal, plastic, cardboard, paperboard, or another appropriate material and/or combination thereof. In an example embodiment, the lid portion 310 may be a foil lid. The lid portion 310 may have information/data printed thereon. For example, the printed information/data may comprise a cleaning solution type indicator, branding, and/or other printed information and/or indicia. The printed information/indicia may be on an exterior surface of the lid portion 310 opposite the side of the lid portion 310 that directly faces the opening of the cup portion 330.

In example embodiments, the lid portion 310 may be sealed to the cup portion 330 to a ridge portion 320 surrounding the opening of the cup portion 330. The ridge portion 320 may be configured to assist in securing the cleaning capsule 300 into the capsule chamber 245. For example, when the cleaning capsule 300 is properly inserted into the capsule chamber 245, the ridge portion 320 may be configured to abut a seat 241 within the capsule chamber 245 of the handle 200. When the lever 240 is in a closed position, the ridge portion 320 may be engaged by both a lip of the lever arm 246 and a seat 241 within the capsule chamber 245, thereby holding the cleaning capsule 300 in place with respect to components of the handle 200.

Exemplary Handle

In example embodiments, the handle 200 comprises a reservoir pipette 215, an atomizer pipette 210, a trigger 220, a nozzle 230, a capsule chamber 245, and a lever 240. In an example embodiment, the lever 240 comprises and/or is coupled to a lever arm 246 and lever arm support(s) 248. The atomizer pipette 210 is configured to, when the trigger 220 is activated, receive cleaning solution via a mouth 412 of the atomizer pipette 210 that is disposed within a reservoir portion 420 of the base 400 and provide the cleaning solution to the nozzle 230. In an example embodiment, the cleaning solution enters the mouth 412 of the atomizer pipette 410 from the reservoir portion 420 of the base such that the cleaning solution may be dispensed (e.g., as a mist, stream, and/or the like) via the nozzle 230. The attachment portion 250 is configured to secure the handle 200 to the base 400 (e.g., via threadings and/or another mating mechanism). In example embodiments, various portions of the handle 200 may comprise aluminum, another metal, and/or other appropriate resilient material.

In example embodiments, the atomizer pipette 210 is attached to the handle 200 and extends out from the bottom of the handle 200 where the attachment portion 250 connects the handle 200 to the base 400. The atomizer pipette 210 is configured to receive cleaning solution into the mouth 412 of the atomizer pipette 210 when the trigger 220 is pulled and/or activated. The atomizer pipette 210 may then provide the cleaning solution to the nozzle 230 for dispensing. The nozzle 230 may be adjustable such that a user may select how directed the stream and/or mist of cleaning solution is that is dispensed through the nozzle 230. In an example embodiment, the nozzle 230 and the general direction in which the nozzle 230 dispenses the cleaning solution defines a nozzle axis. The atomizer pipette 210 defines a pipette axis. The nozzle axis and pipette axis intersect and define a plane. In example embodiments, the angle between the nozzle axis and the pipette axis in the plane is between 60 and 120 degrees. In an example embodiment, the angle between the nozzle axis and the pipette axis in the plane is between 80 and 100 degrees or approximately 90 degrees.

When the handle 200 is secured to the base 400, the cleaning solution may be forced into the atomizer pipette 210, in response to the trigger 220 being activated. For example, a user may squeeze, press, pull, push, or otherwise activate the trigger 220 to cause cleaning solution to be dispensed from the nozzle 230. For example, when the trigger 220 is activated, the cleaning solution is pumped from the reservoir portion 420 through the atomizer pipette 210, and dispensed out of the nozzle 230. For example, the trigger 220 may be actuated to create a pressure differential along the length of the atomizer pipette 210, causing the cleaning solution to be dispensed from the reservoir portion 420 through atomizer pipette xxx, and out of the nozzle 230.

The attachment portion 250 of the handle 200 is configured to secure the handle 200 to the base 400. The attachment portion 250 may comprise threads or another mating mechanism for securing the handle 200 to the base 400. For example, the attachment portion 450 of the base may comprise corresponding threads such that the base 400 may be screwed onto the handle 200.

In various embodiments, the handle further comprises a capsule chamber 245. In an example embodiment, the nozzle 230 is disposed on first end 260 of the handle 200 and the capsule chamber 245 is disposed at, adjacent, and/or proximate to a second end 265 of the handle 200. The first end 260 of the handle 200 and the second end 265 of the handle 200 are located on opposite sides of the handle 200 with respect to the nozzle axis. The capsule chamber 245 portion of the handle 200 is configured to receive the cleaning capsule 300 and comprises one or more elements configured to puncture the cleaning capsule 300 to release the cleaning solution contained within the cleaning capsule 300. In example embodiments, the capsule chamber 245 may comprise a seat 241 configured to have the ridge portion 320 of the cleaning capsule 300 engage therewith. The capsule chamber 245 may further comprise a cup receiving portion 243 configured to receive the cup portion 330 of a cleaning capsule 300 therein. The capsule chamber 245 may further comprise a mechanism for at least partially opening the cleaning capsule 300. For example, the capsule chamber 245 may comprise a first puncture pin 242 configured to at least partially open (e.g., puncture) a first surface of the cleaning capsule 300 (e.g., the lid portion 310 of the cleaning capsule 300) when the lever 240 is moved from an open position to a closed position on the handle 200. A second puncture pin 244 is configured to partially open (e.g., puncture) a second surface of the cleaning capsule 300 (e.g., the capsule cup 330) simultaneous to the first puncture of the first surface (e.g., lid portion 310) of the cleaning capsule 300. This is achieved upon moving of the lever 240 from an open position to a closed position when the cleaning capsule 300 is disposed within the cup receiving portion 243 and the ridge portion 320 of the cleaning capsule 300 is engaged with the seat 241. For example, when the lever 240 is in the open position, a lever arm 246 may be in a position such that the cup receiving portion 243 of the capsule chamber 245 is accessible (e.g., a cleaning capsule 300 may be inserted into and/or removed from the cup receiving portion 243). The lever arm 246 may be supported at least in part in the open position by one or more lever arm supports 248. When the lever 240 is in the closed position, the lever arm 246 is in a position such that the lever arm at least partially covers the cup receiving portion 243 such that cup receiving portion 243 is not accessible (e.g., a cleaning capsule 300 may not be inserted into and/or removed from the cup receiving portion 243). For example, the lever arm 246 may be coupled to the lever 240 (e.g., possibly via the lever arm support(s) 248) such that moving of the lever 240 from the open position to the closed position causes the lever arm 246 into a position where the lever arm 246 encloses and/or at least partially seals the cup receiving portion 243 of the capsule chamber 245. In various embodiments, the lever arm 246 is coupled to the lever 240 (e.g., possibly via the lever arm support(s) 248) such that moving the lever 240 from the closed position to the open position causes the lever arm 246 to move into a position where the cup receiving portion 243 is accessible (e.g., not closed or sealed such that a cleaning capsule may be inserted into and/or removed from the cup receiving portion 243).

In various embodiments, moving the lever 240 from the open position to the closed position causes the lever arm 246 to move to enclose and/or at least partially seal the capsule 300 within the capsule chamber 245. In an example embodiment, moving the lever 240 from the open position to the closed position may cause the capsule chamber 245 to move (e.g., on a hinge mechanism provided via the one or more lever arm supports 248 and/or the like) such that the opening of the cup receiving portion 243 moves toward the lever arm 246. For example, the capsule chamber 245 may move such that a ridge portion 320 of the cleaning capsule 300 disposed within the capsule chamber 245 (e.g., such that the ridge portion 320 is proximate and/or engages seat 241) engages a lip of the lever arm 246.

In various embodiments, the first puncture pin 242 is disposed on and/or coupled to the lever arm 246 such that moving the lever 240 from the open position to the closed position causes the first puncture pin 242 to engage and puncture a first surface (e.g., the capsule lid 310) of a cleaning capsule 300 disposed within the cup receiving portion 243. The second puncture pin 244 may be disposed in the cup receiving portion 243. In an example embodiment, the moving of the lever 240 from the open position to the closed position causes a lip of the lever arm 246 to engage the ridge portion 320 of the cleaning capsule disposed within the cup receiving portion 243, causing the cup 330 to be pressed against the second puncture pin 244 within the cup receiving portion 243 such that the second puncture pin 244 punctures the cup 330. In an example embodiment, the second puncture pin is coupled to the reservoir pipette 215 such that cleaning solution may vacate the cleaning capsule 300 via the puncture in the cup 330 cause by engagement of the second puncture pin 244 with the cup 330 and enter the reservoir pipette 215. For example, the second puncture pin 244 may be a hollow puncture pin affixed to a mouth 217 of the reservoir pipette 215. The reservoir pipette 215 facilitates the flow of concentrated cleaning solution from the cleaning capsule 300 to the reservoir portion 420 of the base 400 for dilution and mixture.

Exemplary Base

In example embodiments, the atomizer 100 comprises a base 400. The base 400 may comprise a reservoir portion 420, and an attachment portion 440. In example embodiments, the attachment portion 440 is configured to secure the base 400 to the handle 200. The reservoir portion 420 is configured to receive cleaning solution therein and provide the cleaning solution to the mouth 412 of the atomizer pipette 210 such that the cleaning solution may be dispensed via the nozzle 230. In example embodiments, the base 400 may comprise aluminum, another metal, or other appropriate material.

In example embodiments, the reservoir portion 420 may comprise a hollow portion within the base 400 configured for receiving cleaning solution therein from the cleaning capsule 300 (e.g., via the reservoir pipette 215). For example, the cleaning capsule 300 may provide cleaning solution to the reservoir portion 420. The reservoir portion 420 may contain the cleaning solution therein. In example embodiments, the reservoir portion 420 may be configured to receive and/or contain a dilution chemical (e.g., water) therein for mixing with concentrated cleaning solution provided by the cleaning capsule 300. In example embodiments, the reservoir portion 420 may be configured to have a dilution chemical (e.g., water) and concentrated cleaning solution mixed therein to provide a diluted concentrated cleaning solution.

The reservoir portion 420 may further comprise an end surface 425. The end surface 425 may define one end of the hollow portion. Wall 427 may join the end surface 425 to the attachment portion 450. The interior of the wall 427 and the end surface 425 may define the hollow portion of the reservoir portion 420. In various embodiments, the end surface 425 is planar, convex, concave, and/or a combination thereof. In example embodiments, the mouth 412 of the atomizer pipette 210 may be located directly below the attachment portion 450 proximate the center of the bottom surface 425, as shown in FIG. 1.

In example embodiments, the attachment portion 450 of the base 400 comprises a mechanism for securing the base 400 to the handle 200. For example, the attachment portion 450 of the base 400 may comprise threads that correspond to threads on the attachment portion 250 of the handle 200 and/or another mating mechanism that corresponds to (e.g., is configured to mate with) the mating mechanism of the attachment portion 250 of the handle 200.

Exemplary Method of Use

FIG. 4 provides a flowchart that illustrates various processes that may be completed to dispense a cleaning solution from an atomizer 100. Starting at block 502, the base 400 is secured to the handle 200. For example, a user may mate the mating mechanism(s), threads, and/or the like of the attachment portion 450 of the base 400 with the corresponding mating mechanism(s), threads, and/or the like of the attachment portion 250 of the handle 200. In an example embodiment, a user may add a dilution chemical (e.g., water) to the reservoir portion 420 of the base 400 prior to securing the base 400 to the handle 200. For example, the reservoir portion 420 and/or base 400 may include a fill line and the user may add the dilution chemical to the reservoir portion 420 until the dilution chemical reaches the fill line. Various other mechanisms may be used to guide a user in adding an appropriate amount of the dilution chemical (e.g., water) to the reservoir portion 420 of the base 400 in various embodiments.

At block 504, with the lever 240 in the open position, a cleaning capsule 300 is inserted into a capsule chamber 245 of the handle. For example, a user may insert a cleaning capsule 300 into the capsule chamber 245 of the handle 200 such that the cup portion 330 of the cleaning capsule is within the cup receiving portion 243 and the ridge portion 320 rests against and/or proximate a seat 241 of the capsule chamber 245. For example, the cup portion 300 may be pressed against and/or proximate a second puncture pin 244 of the capsule chamber 245. In some embodiments, the user may press the cleaning capsule 300 into the capsule chamber 245 until the second puncture pin 244 punctures the cup portion 330 to create a puncture hole. In other embodiments, the cleaning capsule 300 may rest against and/or be positioned in the vicinity of the second puncture pin 244 but not actually engaged with the second puncture pin 244 at this point.

At block 506, the lever 240 is moved from an open position to a closed position. In example embodiments, moving the lever 240 from the open position to the closed position causes the lever arm 246 coupled to the lever 240 to enclose and/or at least partially seal the cup receiving portion 243 of the capsule chamber 245. For example, moving the lever 240 from the open position to the closed position causes the lever arm 246 to secure the cleaning capsule 300 within the capsule chamber 245. For example, a lip of the lever arm 246 may engage the lid 310 side of ridge portion 320 of the cleaning capsule 300 to press the opposite side of the ridge portion 320 (e.g., the cup portion 330 side) against and/or into engagement with the seat 241 of the capsule chamber 245. Moving of the lever 240 from the open position to the closed position may further cause the first puncture pin 242 to open (e.g., puncture) the lid portion 310. Thus, a puncture hole may be created in the lid portion 310. If the second puncture pin 244 has not yet punctured the cup portion 330, closing of the lever 400 may cause the second puncture pin 244 to puncture the cup portion 330. Thus, the cleaning solution may be infused, released, provided, and/or the like into the reservoir pipette 215. In some embodiments, the cleaning solution is not infused, released, provided and/or the like into the reservoir pipette 215 until both the first puncture pin 242 and the second puncture pin 244 have punctured the cleaning capsule 300. In various embodiments, the cleaning solution flows through the mouth 217 of the reservoir pipette 215, through the reservoir pipette 215, and into the reservoir portion 420.

In an example embodiment, as noted above, before securing the handle 200 to the base 400, the reservoir portion 420 may be at least partially filled with a dilution chemical (e.g., water). Thus, when the concentrated cleaning solution is provided to the reservoir portion 420 (when the lever 240 is moved from the open position to the closed position), the resulting cleaning solution in the reservoir portion 420 may be a regular strength cleaning solution. For example, the concentrated cleaning solution provided by the cleaning capsule 300 to the reservoir portion 420 through the reservoir pipette 215 may be diluted to a less concentrated cleaning solution.

At block 508, the atomizer 100 may be shaken. For example, the user may shake the atomizer 100. In example embodiments, shaking the atomizer 100 may cause at least a portion of any cleaning solution still residing the cleaning capsule 300 to be infused, released, and/or provided to the reservoir portion 420 through the reservoir pipette 215. In another example, shaking the atomizer 100 may cause the concentrated cleaning solution to mix generally uniformly with any dilution chemical (e.g., water) within the reservoir portion 420 such that the resulting solution is a diluted concentrated cleaning solution.

At block 510, the trigger 220 may be activated to cause the cleaning solution to be dispensed. For example, the user may activate the trigger 220 by pulling, pushing, pumping, pressing, squeezing, or otherwise activating the trigger 220. When the trigger 220 is activated, a pressure differential along the length of the atomizer pipette 210 may cause cleaning solution to enter the mouth 412 of the atomizer pipette 210, and be provided to the nozzle 230, from which the cleaning solution is dispensed. Thus, activating the trigger 220 causes cleaning solution to be dispensed from the reservoir portion 420, through atomizer pipette 210, and out of the nozzle 230.

CONCLUSION

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An atomizer for dispensing a cleaning solution from a capsule, the atomizer comprising:
- a handle, the handle comprising:
  - a nozzle,
  - a trigger,
  - a lever configured to be moved between an open position and a closed position,
  - an atomizer pipette, and
  - a capsule chamber configured to receive a capsule therein;
- a base, the base comprising:
  - a reservoir portion configured for receiving cleaning solution from the capsule;
- wherein (a) the handle is configured to be secured to the base, (b) when the capsule is positioned within the capsule chamber and the lever is moved from the open position to the closed position, the cleaning solution is provided to the reservoir portion, (c) when the trigger is activated, the cleaning solution is dispensed from the reservoir portion through the atomizer pipette and out of the nozzle, (d) when the lever is in the open position, the capsule chamber is accessible for insertion or removal of the capsule, and (e) when the lever is in the closed position, the lever at least partially covers the capsule chamber to prevent the insertion or removal of the capsule therefrom.

2. The atomizer of claim 1, wherein the handle further comprises a reservoir pipette and when the lever is moved from the open position to the closed position, the cleaning solution is provided to the reservoir portion via the reservoir pipette.

3. The atomizer of claim 2, wherein the lever is coupled to a first puncture pin configured to puncture a first surface of the capsule positioned within the capsule chamber when the lever is moved from the open position to the closed position.

4. The atomizer of claim 3, wherein the capsule chamber comprises a second puncture pin configured to puncture a second surface of the capsule positioned within the capsule chamber, the second surface being a different portion of an external surface of the capsule than the first surface.

5. The atomizer of claim 4, wherein the puncturing of the second surface by the second puncture pin is caused by the lever being moved from the open position to the closed position.

6. The atomizer of claim 4, wherein the second puncture pin is coupled to the reservoir pipette such that cleaning solution exiting the capsule via a puncture generated by the second puncture pin enters a mouth of the reservoir pipette.

7. The atomizer of claim 6, wherein the second puncture pin is hollow.

8. The atomizer of claim 1, wherein the reservoir portion is configured to receive a dilution chemical configured to dilute the cleaning solution, and wherein the dilution chemical is dispensed from the reservoir portion through the pipette and out of the nozzle with the cleaning solution.

9. The atomizer of claim 8, wherein the dilution chemical comprises water.

10. The atomizer of claim 1, wherein the capsule chamber comprises a second puncture pin configured to puncture a cup portion of the capsule.

11. The atomizer of claim 1, wherein the capsule is configured to contain 1-2 ounces of the cleaning solution.

12. The atomizer of claim 1, wherein the base comprises a metal.

13. The atomizer of claim 1, wherein the reservoir portion has a capacity of 10-30 ounces.

14. A method of dispensing a cleaning solution from a capsule, the method comprising:

providing an atomizer, the atomizer comprising:

a handle configured to (a) receive a capsule containing cleaning solution therein and (b) be secured to a base, the handle comprising:

a nozzle, a trigger, a lever configured to move between an open position and a closed position, an atomizer pipette, and a capsule chamber; and the base, the base comprising:

a reservoir portion configured for receiving cleaning solution from the capsule;

inserting the capsule into the capsule chamber;

moving the lever from the open position to the closed position, wherein the moving of the lever from the open position to the closed position causes the cleaning capsule to be opened to enable the cleaning solution to flow into the reservoir portion;

diluting the cleaning solution with a dilution chemical in the reservoir portion; and activating the trigger, thereby causing cleaning solution and dilution chemical to be dispensed from the reservoir portion, through the atomizer pipette, and out of the nozzle.

15. The method of claim 14, further comprising, after adding the dilution chemical to the reservoir portion of the base, securing the base to the handle.

16. The method of claim 15, wherein the base is secured to the handle prior to the inserting of the capsule into the capsule chamber.

17. The method of claim 14, wherein the handle further comprises a reservoir pipette and the cleaning solution flows through the reservoir pipette from the capsule into the reservoir portion.

18. The method of claim 14, wherein the handle further comprises a first puncture pin and a second puncture pin and moving the lever from the open position to the closed position causes the first puncture pin to puncture a first surface of the capsule.

19. The method of claim 18, wherein moving the lever from the open position to the closed position causes the second puncture pin to puncture a second surface of the capsule, the second surface being a different portion of an external surface of the capsule than the first surface.

* * * * *